US005301370A

United States Patent [19]

Henson

[11] Patent Number: 5,301,370

[45] Date of Patent: Apr. 12, 1994

[54] SHIN PAD WITH ACHILLES TENDON PROTECTION

[75] Inventor: Anthony E. Henson, Harbord, Australia

[73] Assignee: Albion Hat & Cap Company Pty Limited, Chippendale, Australia

[21] Appl. No.: 232

[22] Filed: Jan. 4, 1993

[30] Foreign Application Priority Data

Jan. 23, 1992 [AU] Australia ..... PL0539

[51] Int. Cl.[5] ..... A41D 13/00

[52] U.S. Cl. ..... 2/22; 2/24; 2/267; 602/60; 602/62

[58] Field of Search ..... 2/2, 22, 23, 24, 267, 2/268; 602/60, 62, 63

[56] References Cited

U.S. PATENT DOCUMENTS

| | | | |
|---|---|---|---|
| 3,135,964 | 6/1964 | Pender | 2/22 |
| 3,585,639 | 6/1971 | Enicks | 2/22 |
| 3,772,704 | 11/1973 | Carbonneau | 2/22 |
| 3,898,697 | 8/1975 | Whitehead | 2/22 |
| 4,041,940 | 8/1977 | Frankel et al. | 2/24 |
| 4,306,315 | 12/1981 | Castiglia | 2/22 |
| 4,484,360 | 11/1984 | Leighton . | |
| 4,497,070 | 2/1985 | Cho | 2/22 |
| 4,627,108 | 12/1986 | Jarvinen | 2/22 |
| 4,633,529 | 1/1987 | Litz | 2/22 |
| 4,674,157 | 6/1987 | Litz | 2/22 |
| 4,692,946 | 9/1987 | Jurga | 2/22 |
| 4,700,406 | 10/1987 | Meistrell | 2/22 |
| 4,847,913 | 7/1989 | Chen . | |
| 4,888,826 | 12/1989 | Parsons, Jr. et al. | 2/22 |
| 4,959,875 | 10/1990 | Moon | 2/22 |
| 4,999,847 | 3/1991 | Barcelo | 2/22 |

FOREIGN PATENT DOCUMENTS

| | | | |
|---|---|---|---|
| 971302 | 7/1975 | Canada | 2/22 |
| 2607628 | 9/1977 | Fed. Rep. of Germany | 2/22 |
| 3542983 | 6/1987 | Fed. Rep. of Germany . | |
| 2600900 | 1/1988 | France . | |

*Primary Examiner*—Clifford D. Crowder
*Assistant Examiner*—Gloria Hale
*Attorney, Agent, or Firm*—Ladas & Parry

[57] ABSTRACT

A shin pad includes a front pad (21) for protecting a wearer's shin and a rear pad (22) for protecting the wearer's Achilles tendon. The front pad (21) has a bight (23) located between two lobes (24, 25) which each cover one of the two ankle bones which protrude in opposite directions at the wearer's ankle. The rear pad (22) takes the form of a miniature shin pad having a reversed orientation. The lower edge of the rear pad (22) is provided with a bight (33). Located one to either side of the longitudinal axis of the rear pad (22) is one slit of a pair of slits (36). Passing through the slits (36), and a corresponding pair of slits (30) on the front pad (21), is an ankle strap (37) which is provided with a releasable hook and loop VELCRO fastener (38) to enable the two pads to be connected together around the wearers shin.

17 Claims, 5 Drawing Sheets

SHIN PAD WITH ACHILLES TENDON PROTECTION

The present invention relates to shin pads and, in particular, to a shin pad with Achilles tendon protection.

In many sports such as football (in all its various codes), hockey, and so on, it is known to provide protection for the shin of a player by means of a shin pad. Whilst the protection afforded by shin pads covers the front facing portion of the player's legs, it is also possible for players to receive a blow from either the boot, hockey stick, or ball on the Achilles tendon. This is particularly painful. However, hitherto most shin pads have not provided any protection for the Achilles tendon.

In recent times at least two attempts have been made to provide some protection for the Achilles tendon area, however, this protection has been in the form of an anklet or sock which envelopes the entire ankle region and which is worn under the normal socks worn by all competitors in the game. Accordingly, such protection is extremely uncomfortable in that a great deal of perspiration is generated within the sock or anklet.

It is known from U.S. Pat. No. 4,982,447 (assigned to the present applicant) to provide shoulder pads, shin pads and arm pads formed from foamed plastics material which include a number of protrusions, grooves and apertures which facilitate the movement of air over the player's body. In this way the player is kept relatively cool notwithstanding the wearing of the pad(s).

The object of the present invention is to provide a shin pad with Achilles tendon protection and which, in its preferred embodiment, is able to be fabricated in accordance with the general principles underlying the disclosure of the above mentioned U.S. patent.

According to the present invention there is disclosed a shin pad with an Achilles tendon protection, said shin pad comprising a first flexible elongated pad having a longitudinal extent sufficient to cover the shin of a wearer, a second flexible elongate pad having a longitudinal extent less than that of said first pad, and releasable fastener means interconnecting said first and second pads in opposed relationship when unreleased. A manufacturing process is also disclosed.

Figure 1:
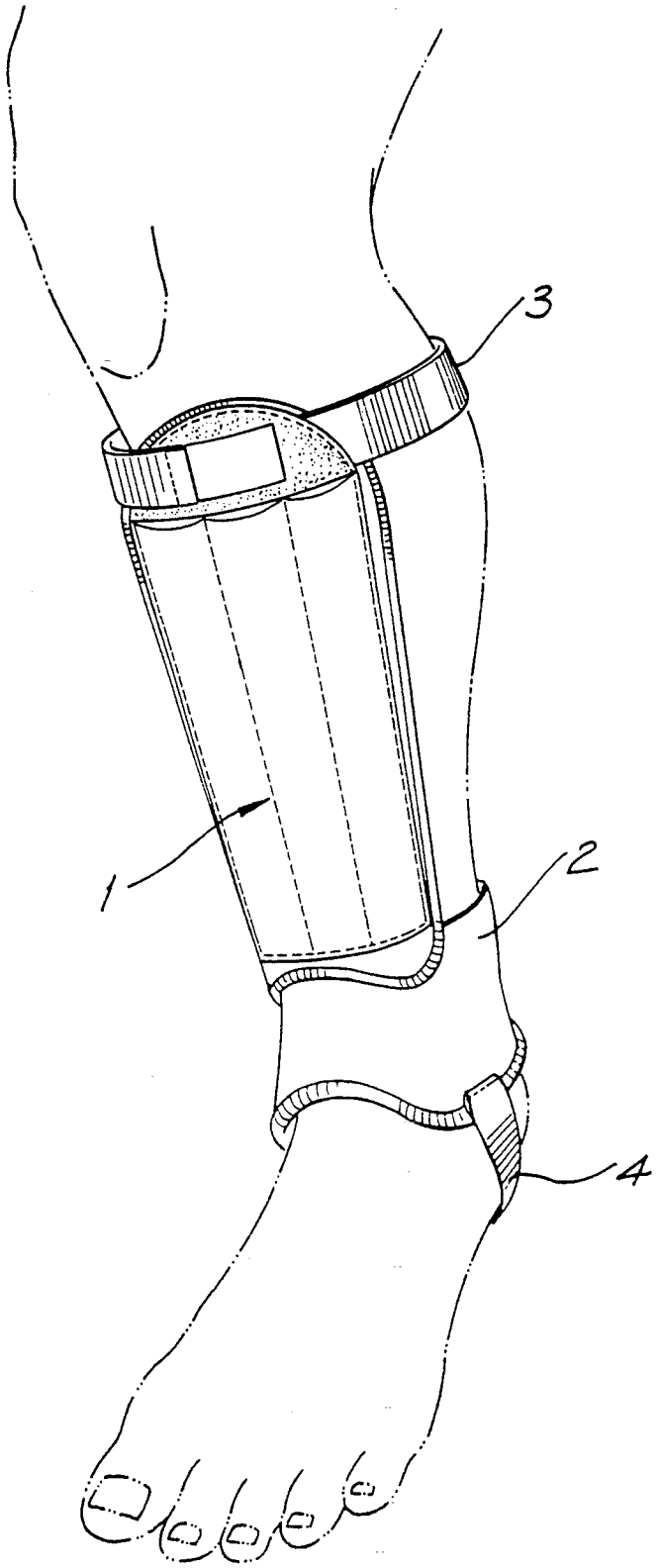
FIG. 1 PRIOR ART
Figure 2:
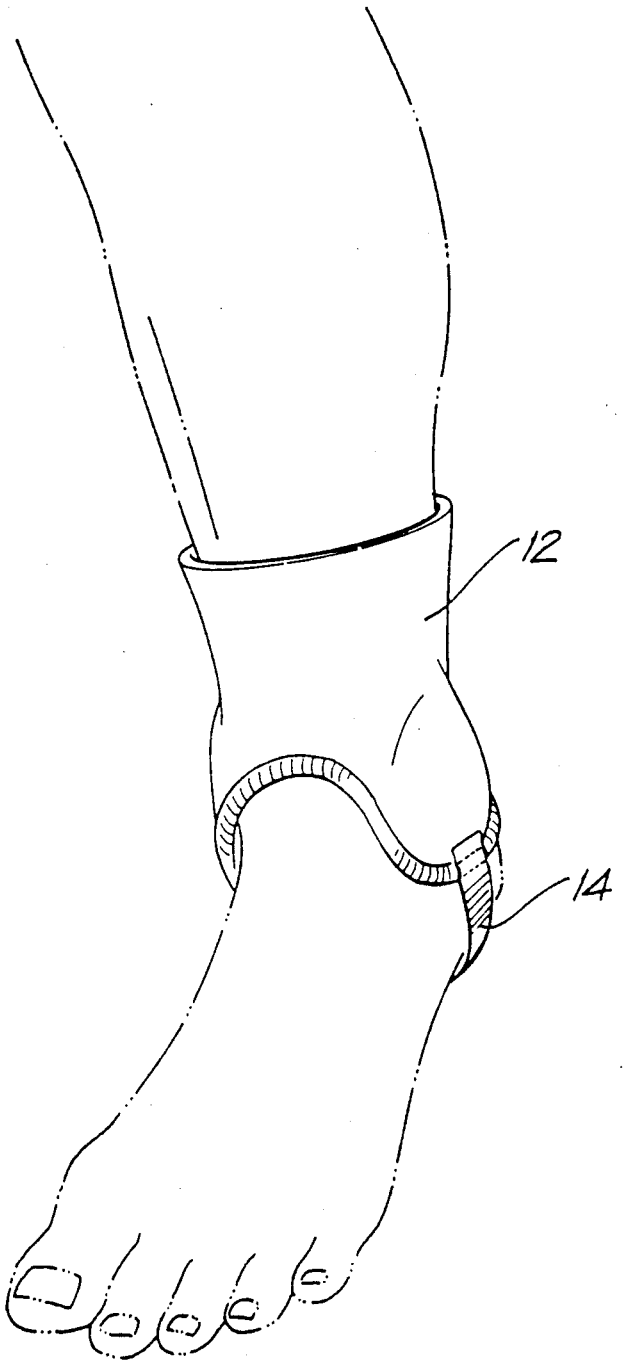
FIG. 2 PRIOR ART
Figure 3:
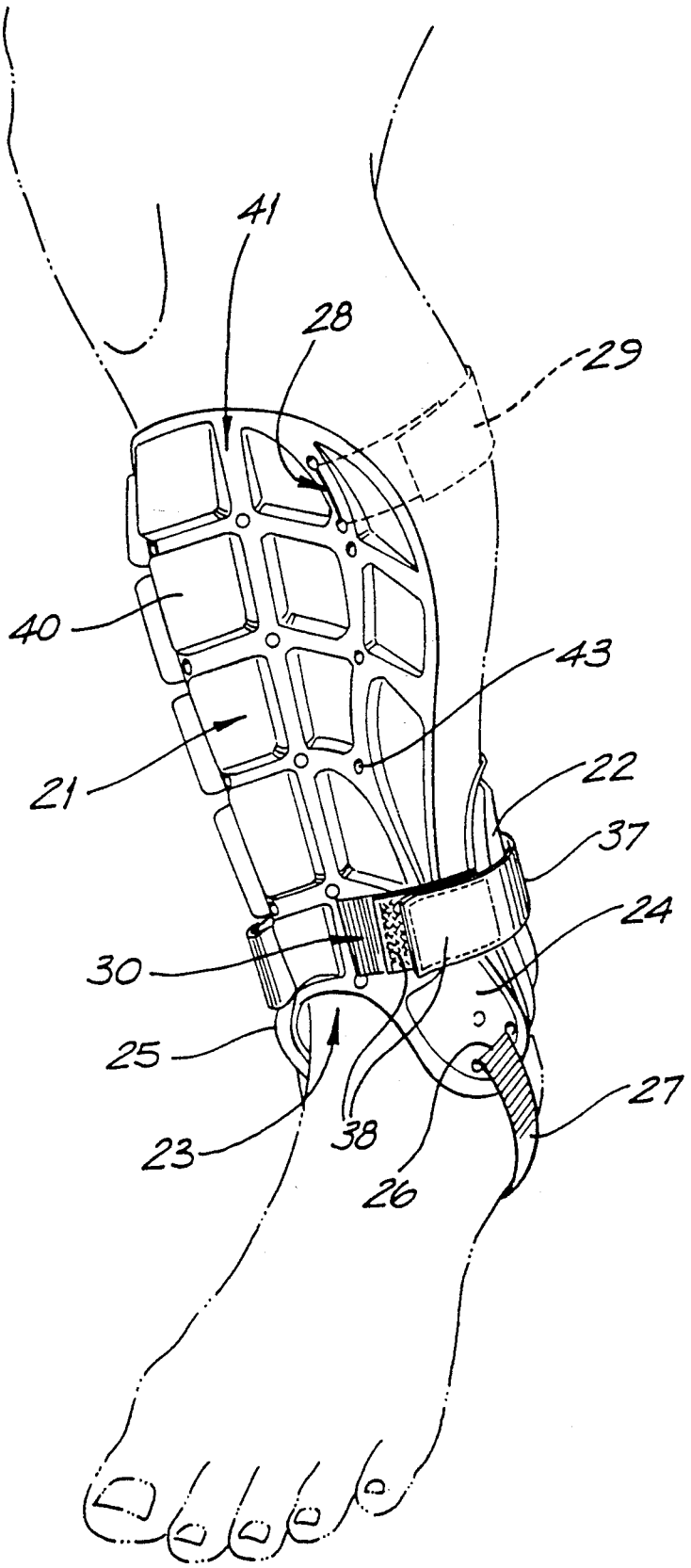
Figure 4:
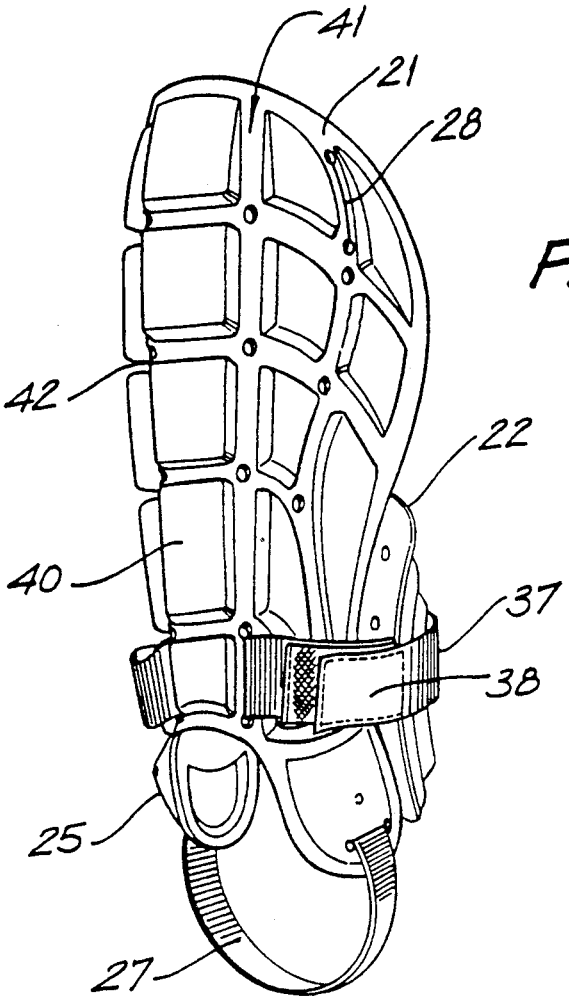
Figure 5:
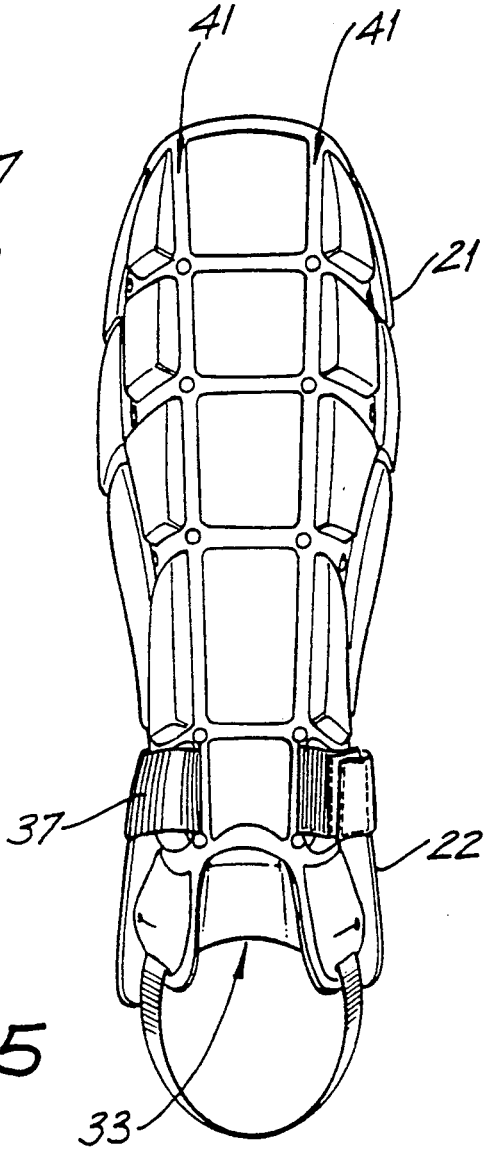
Figure 6:
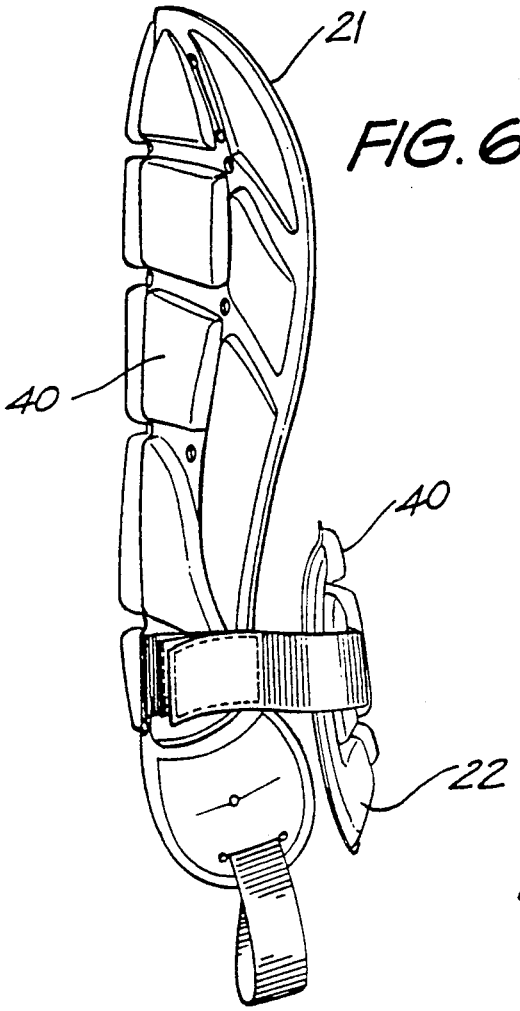
Figure 7:
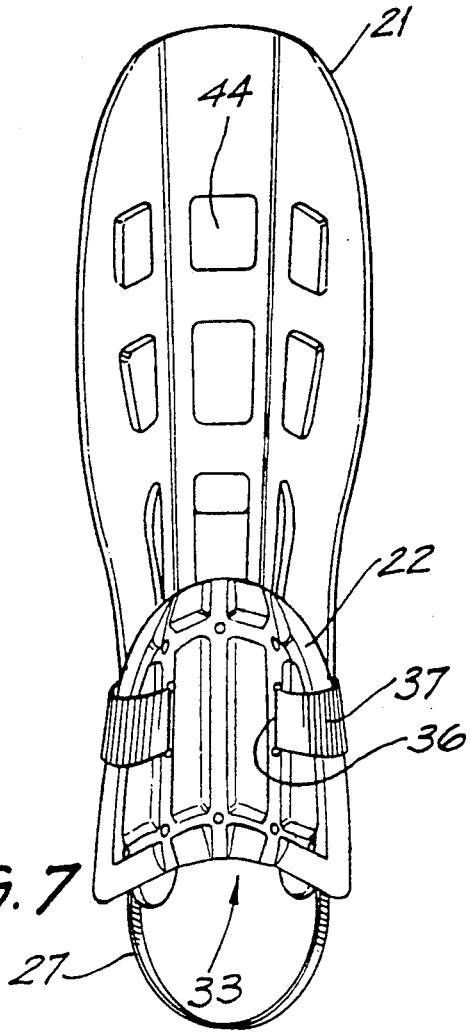
Figure 8:
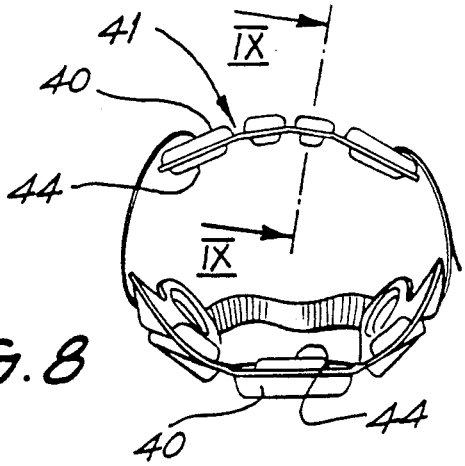
Figure 9:
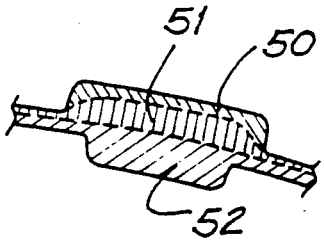

The preferred embodiment of the present invention will now be described with reference to the drawings in which:

FIG. 1 is a front perspective view of a first prior art shin pad with limited Achilles tendon protection, FIG. 2 is a front perspective view of a second, generally similar, prior art pad, FIG. 3 is a front perspective view of the preferred embodiment of the shin pad of the present invention showing the shin pad as worn, FIG. 4 is a front perspective view of the shin pad alone, FIG. 5 is a front view of the shin pad of FIG. 4, FIG. 6 is a right side view of the of shin pad of FIG. 4, FIG. 7 is a rear view of the shin pad of FIG. 4, FIG. 8 is a plan view of the shin pad of FIG. 4; and FIG. 9 is a cross-sectional view of a portion of FIG. 8

As seen in FIG. 1, the first form of prior art shin pad takes the form of a shin pad 1 which is secured to an ankle sock 2 the arrangement being held in place by a calf strap 3 and a stirrup strap 4.

The ankle sock 2 is formed from two layers of elasticised material between which is located a soft pad. Accordingly the ankle sock 2 is very close fitting and therefore extremely hot. The sock 2 causes a great deal of perspiration when used.

A second prior art attempt to provide Achilles tendon protection is illustrated in FIG. 2. Here again an ankle sock 12 is provided having a stirrup strap 14. Again the ankle sock 12 is formed from two layers of elastic fabric between which are located various forms of padding (not illustrated). In this particular arrangement the padding takes the form of two dome shaped protectors which cover the points of the ankle bone and a further layer of padding arranged between the two layers of material and covering the Achilles tendon in use. Again, the ankle sock 12 is extremely hot and therefore relatively uncomfortable for the player.

As best seen in FIGS. 3 and 6, the preferred arrangement of the present invention takes the form of two pads namely a front pad 21 and a rear pad 22. The front pad 21 has a bight 23 located between two lobes 24, 25 which each cover one of the two ankle bones which protrude in opposition directions at the wearer's ankle.

At the lowermost end of each of the lobes 24, 25 is located a slit 26 through which passes a stirrup strap 27 having a releasable VELCRO (Registered Trade Mark) hook and loop fastener. The stirrup strap 27 enables the front pad 21 to be maintained in position against upwardly urging vertical forces. As best seen in FIG. 3, a second pair of slits 28 is provided so as to enable the optional use of a calf strap 29, if desired.

As best seen in FIGS. 6 and 7, the rear pad 22 takes the form of a miniature shin pad having a reversed orientation. The lower edge of the rear pad 22 is provided with a bight 33. Located one to either side of the longitudinal axis of the rear pad 22 is one slit of a pair of slits 36. Passing through the slits 36, and a corresponding pair of slits 30 on the front pad 21, is an ankle strap 37 which is again provided with a releasable VELCRO hook and loop fastener 38.

Distributed over the front surfaces of both pads 21 and 22 are bosses 40 formed by a number of intersecting grooves 41 in the outer surface of the pads 21, 22. At the intersection of the grooves 41 are located through apertures 42. Similarly, the inner surfaces of the pads 21 and 22 are preferably provided with protrusions 44 which are generally similar to the bosses 40.

The bosses 40, protrusions 44, grooves 41 and apertures 42 combine to enable a degree of airflow to be achieved so that air can pass between the pads 21 and 22 and the skin of the wearer. In this way, the air can evaporate perspiration so as to cause a cooling effect bought about through the action of latent heat.

Each of the pads 21 and 22 is preferably formed from foamed moulded plastics such as close cell polyethylene foam or close cell ethyl vinyl acetate (EVA) foam. This material is arranged in three layers. The outer layer 50 is a relatively tough skin formed using pressures to produce a density of the layer within the range of from 180 to 350 (preferably 220) kg/cubic meter. The next, middle, layer 51 is slightly less hard being formed with pressures to produce a density of the layer in the range of from 60 to 120 (preferably 100) kg/ cubic meter. Finally, the innermost layer 52 which contacts the body of the wearer is the softest and is formed from pressures to produce a density of the layer in the range of from 40 to 60 (preferably 45) kg/ cubic meter. The outer layer 50 is approximately 4 mm thick, the middle layer 51 is about 3 mm thick and the inner layer 52 is approximately 9–10 mm thick so that the inner layer constitutes approximately half of the total thickness. The grooves 41 are approximately 4 mm wide and 10 mm deep whilst the apertures 42 are approximately 4 mm in diameter.

The foregoing describes only one embodiment of the present invention, and modifications obvious to those skilled in the art can be made thereto without departing from the scope of the present invention. For example the stirrup strap 27 can be made optional like the calf strap 29 of FIG. 3.

What I claim is:

1. A sporting shin pad with Achilles tendon protection for a sport playing wearer having a leg including skin, a shin, ankle bones and an Achilles tendon; said shin pad comprising:

a first flexible elongate pad having a longitudinal extent sufficient to cover the shin of the wearer, said first pad further having a pair of first lobes and a first bight located between the lobes at a first, lower, end of said first pad, said lobes being positioned to cover the ankle bones of the wearer;

a second flexible elongate pad having a longitudinal extent sufficient to cover the Achilles tendon of the wearer, said second pad further having a pair of second lobes and a second bight located therebetween at a first, lower, end of said second pad, wherein said first and second pads have a plurality of bosses extending from the outer surfaces thereof, and a plurality of protrusions extending from the inner surfaces thereof to bear against the wearer's skin, said bosses being delineated by an array of intersecting grooves, said protrusions being distributed over said inner surfaces and a plurality of through apertures located at some of the intersection of said grooves and extending through said pads and spaced between said protrusions, the arrangement of protrusions, apertures, bosses and grooves defining a plurality of air passages communicating the skin of the wearer with the outer surface of said pads; and releasable securing means for securing said pads to said wearer.

2. A shin pad according to claim 1, wherein said second pad is provided with a bight at a lower end thereof.

3. A shin pad according to claim 1, wherein said grooves are approximately 4 mm wide and 10 mm deep.

4. A shin pad according to claim 1, wherein said apertures are approximately 4 mm in diameter.

5. A skin pad according to claim 1 wherein said releasable securing means comprises a stirrup strap having a first releasable fastener thereon and configured to extend from said lobes to restrain said first pad against longitudinal upward movement of the shin, and an ankle strap having a second releasable fastener means for coupling said first pad to said second pad.

6. A shin pad according to claim 1 wherein said first and second pads are formed from foamed moulded plastics material arranged with a relatively hard outer layer, a relatively soft inner layer arranged to abut the leg, and a middle layer of a hardness intermediate that of said outer and inner layers.

7. A shin pad according to claim 6, wherein the plastics material is close cell polyethylene foam.

8. A shin pad according to claim 6, wherein the plastics material is close cell ethyl vinyl acetate foam.

9. A shin pad according to claim 6, wherein said outer layer is approximately 4 mm thick.

10. A shin pad according to claim 6, wherein said middle layer is approximately 3 mm thick.

11. A shin pad according to claim 6, wherein said inner layer is approximately 9–10 mm thick.

12. A shin pad according to claim 6, wherein the relatively hard outer layer is formed using pressures to produce a density of the layer within the range 180 to 350 kg/cubic meter.

13. A shin pad according to claim 12 wherein the density is 220 kg/cubic meter.

14. A shin pad according to claim 6 wherein the intermediate middle layer is formed using pressures to produce a density of the layer within the range 60 to 120 kg/cubic meter.

15. A shin pad according to claim 14, wherein the density is 100 kg/cubic meter.

16. A shin pad according to claim 6, wherein the relatively soft inner layer is formed using pressures to produce a density of the layer within the range 40 to 60 kg/cubic meter.

17. A shin pad according to claim 16, wherein the density is 45 kg/cubic meter.

* * * * *